US007152327B2

(12) United States Patent
Rudisill et al.

(10) Patent No.: US 7,152,327 B2
(45) Date of Patent: Dec. 26, 2006

(54) SIDE FOLDING KNIFE

(76) Inventors: Kent W. Rudisill, 2520 SW. 45 St., Corvalis, OR (US) 97333; Walter S. Rowe, P.O. Box 2343, Lebanon, OR (US) 97355

( * ) Notice: Subject to any disclaimer, the term of this patent is extended or adjusted under 35 U.S.C. 154(b) by 378 days.

(21) Appl. No.: 10/911,535

(22) Filed: Aug. 5, 2004

(65) Prior Publication Data

US 2006/0026843 A1 Feb. 9, 2006

(51) Int. Cl.
*B26B 3/06* (2006.01)

(52) U.S. Cl. ..... 30/155; 30/153

(58) Field of Classification Search ..... 30/153, 30/155, 156, 157

See application file for complete search history.

(56) References Cited

U.S. PATENT DOCUMENTS

| | | | | | |
|---|---|---|---|---|---|
| 244,498 | A * | 7/1881 | Terpany | 81/488 |
| 878,509 | A * | 2/1908 | Dillard | 446/401 |
| 1,321,670 | A * | 11/1919 | Popper | 30/143 |
| 2,199,899 | A * | 5/1940 | Watson | 81/437 |
| 4,083,110 | A * | 4/1978 | Goldin et al. | 30/155 |
| D275,449 | S * | 9/1984 | Ferraro | D8/99 |
| 4,947,551 | A * | 8/1990 | Deisch | 30/161 |
| 5,437,101 | A * | 8/1995 | Collins | 30/153 |
| 5,953,821 | A * | 9/1999 | Mearns | 30/161 |
| 6,113,617 | A * | 9/2000 | van der Merwe | 606/167 |

* cited by examiner

*Primary Examiner*—Kenneth E. Peterson
*Assistant Examiner*—Sean Michalski
(74) *Attorney, Agent, or Firm*—Norman B. Rainer

(57) ABSTRACT

A folding knife is provided having a handle that pivotably holds a blade member adapted to be housed within the handle in a storage state, and to be deployed to a service state by swinging laterally and forwardly in a path orthogonal to the handle. The handle is constructed of facing first and second members elongated between front and rear extremities, and defining a compartment which houses the blade member. The second handle member is pivotably joined to the first handle member in a manner to permit rearward swinging movement which opens the compartment to allow deployment of the blade member. Forwardly returning movement of the second handle member secures the blade member in its service state.

6 Claims, 2 Drawing Sheets

SIDE FOLDING KNIFE

BACKGROUND OF THE INVENTION

1. Field of the Invention

This invention relates to folding knives, and more particularly concerns a folding knife wherein a blade member pivots laterally between a deployed position and a storage position within a supporting handle.

2. Description of the Prior Art

Folding knives are generally styled and dimensioned so that they can be used as pocket knives. In most such knives a blade component is pivotable from a closed position within the confines of a handle component to an open position with the blade extending forwardly from and supported by the handle.

The handle of the folding knife generally has a slotted configuration, and the blade is foldable in its own plane about a pivot pin orthogonally positioned with respect to the slot and a tang portion of the blade. The cutting edge of the blade enters the handle slot first, and its dull back portion protrudes from the slot, thereby enabling the user to grasp the protruding back of the blade and swing it out of the slot to a deployed state forwardly and in line with the handle. The blade is generally held in its deployed state by a leaf spring interactive between the handle and the tang of the blade.

One of the problems encountered with such typical folding blade pocket knives is that the blade travels in the direction of its edge when it folds, either deliberately or accidentally, toward its storage state. Such action can cut the hand of the user. Also, knives of this type are not able to withstand the forces that can be withstood by a rigid blade knife, such as the typical hunter's knife. Furthermore, the pivot pin and leaf spring of the conventional folding blade knife are subject to deterioration and wear, causing the blade to become loose after extended rugged use.

U.S. Pat. Nos. 4,083,110 and 4,536,959 disclose folding knives wherein the blade is mounted to the handle by a pivot pin within the plane of the blade and handle, thereby enabling the blade to swing laterally or sideways with respect to the handle. Such functionality eliminates problems inherent in the aforementioned more commonplace designs. However, a newly encountered problem is the inadvertent folding of the blade with respect to the handle when the knife is used. This is most likely to occur when a lateral force is being applied to the blade, as when the blade is used in a scraping or prying action.

It is accordingly an object of the present invention to provide a foldable blade knife having a blade adapted to swing sideways with respect to an elongated handle that houses said blade in a storage state and supports said blade in a deployed state forwardly of said handle and in line therewith, said knife constructed so as to reduce the hazard of inadvertent folding of said blade during use.

It is another object of this invention to provide a folding knife of the aforesaid nature of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a folding knife comprising:

a) a handle comprised of first and second elongated members having substantially identical perimeter configurations defined by substantially parallel upper and lower edges, and front and rear extremities, each member having a flat interior surface, said first member having emergent from its interior surface a spacing shoulder adjacent said rear extremity, and pivot holding means adjacent its front extremity, said second handle member being pivotably joined to said spacing shoulder in a manner permitting swinging movement between a rearward open position and forward closed position wherein said interior surfaces are in facing relationship defining a compartment whose width is determined by said spacing shoulder, and motion limiting means associated with the lower edge of said second handle member adjacent its forward extremity, and b) a blade member having a cutting edge; and oppositely located non-cutting back edge, a distal pointed tip, a proximal extremity having a tang portion whose thickness equals the width of said chamber, and pivot means associated with said tang portion in a manner to interact with said pivot holding means on an axis orthogonal to said upper and lower edges and centered between said interior surfaces, the length of said blade, measured between said tip and proximal extremity being such as to fit within said compartment, whereby c) said blade member resides within said compartment in the storage state of said knife, and can be deployed to a service state by swinging said second handle member rearwardly in a plane parallel to said first handle member, swinging said blade member laterally and forwardly in a plane orthogonal to said first handle member, and returning said second handle member forwardly until stopped by said motion limiting means, at which point said tang is securely embraced by abutment with the opposed interior surfaces of said handle members.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
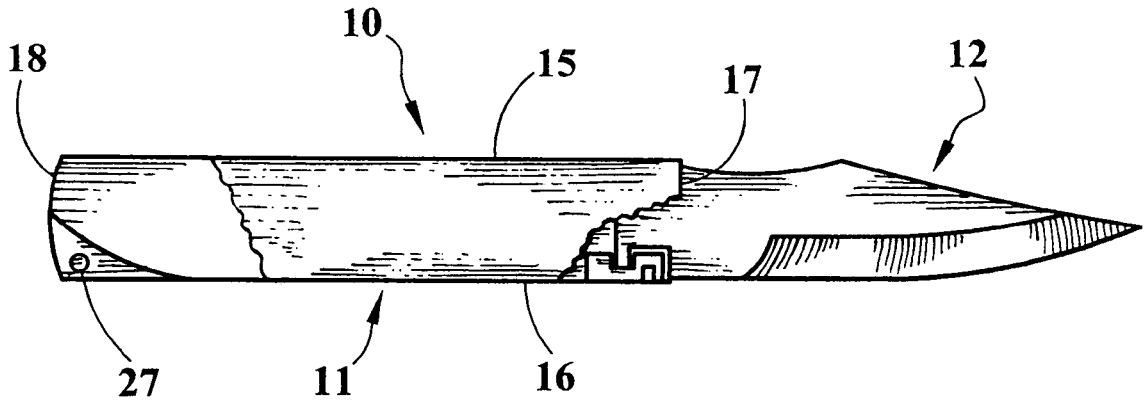
FIG. 1 is a side view of an embodiment of the folding knife of this invention shown in its service state and with portions broken away to reveal interior details.

Referring now to FIGS. 1–6, an embodiment of the side folding knife 10 of the present invention is shown comprised of handle 11 and blade member 12 pivotably supported by said handle.

Handle 11 is comprised of first and second elongated members 13 and 14, respectively, having substantially identical perimeter configurations defined by substantially parallel upper and lower edges 15 and 16, respectively, and front and rear extremities 17 and 18, respectively. Each handle member has a flat interior surface 19. Said handle members are fabricated of rigid, durable material such as metal, wood or engineering grade plastic.

A spacing shoulder 20, having an upwardly concave upper contour 21 and flat side surface 31 is emergent from the interior surface of said first handle member and extends between rear extremity 18 and lower edge 16. Pivot holding means in the form of upper and lower bearing blocks 22 and 23, respectively, are emergent from interior surface 19 of said first handle member 13 in facing relationship adjacent front extremity 17 and contiguous with upper and lower edges 15 and 16, respectively. Said bearing blocks contain aligned cylindrical recesses 24 for receiving pivot stubs 25 of said blade member, as will be shown hereinafter. Said bearing blocks are bounded in part by flat distal surfaces 30 which are coplanar with side surface 31 of spacing shoulder 20. The aforesaid spacing shoulder 20 and bearing blocks may be separately secured to said first handle member by threaded fasteners or other attachment means, or may be integral features of a monolithic handle member fabricated of metal or plastic in a molding operation.

Figure 2:
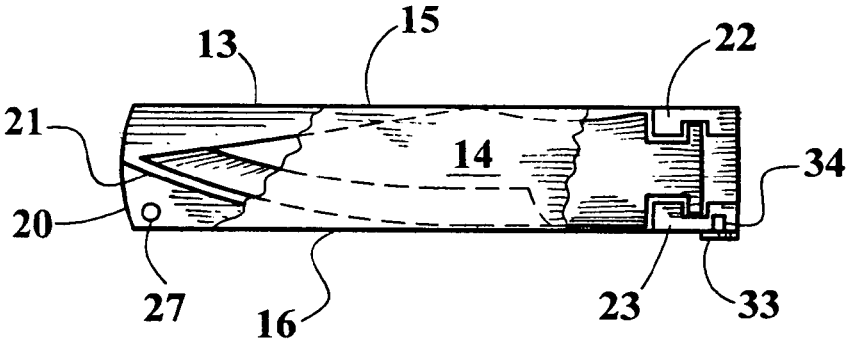
FIG. 2 is a side view of the knife of FIG. 1 shown in its storage state.
Figure 3:
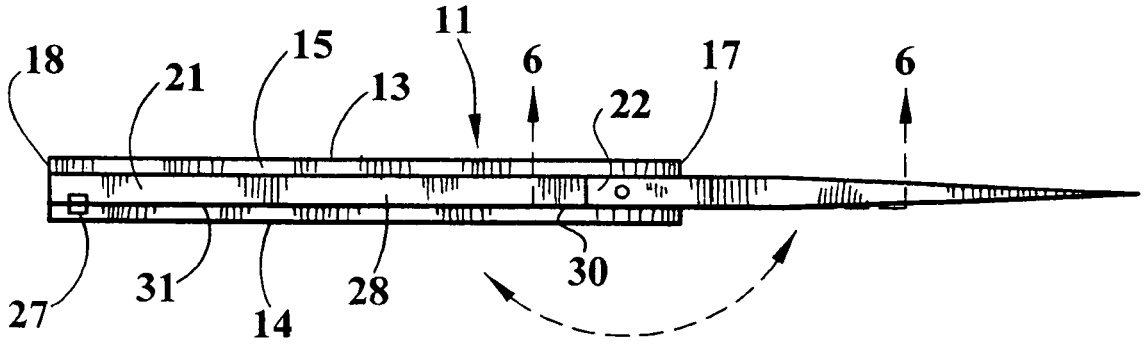
FIG. 3 is a top view of the embodiment of FIG. 1 showing the direction of movement of the blade between service and storage states.
Figure 4:
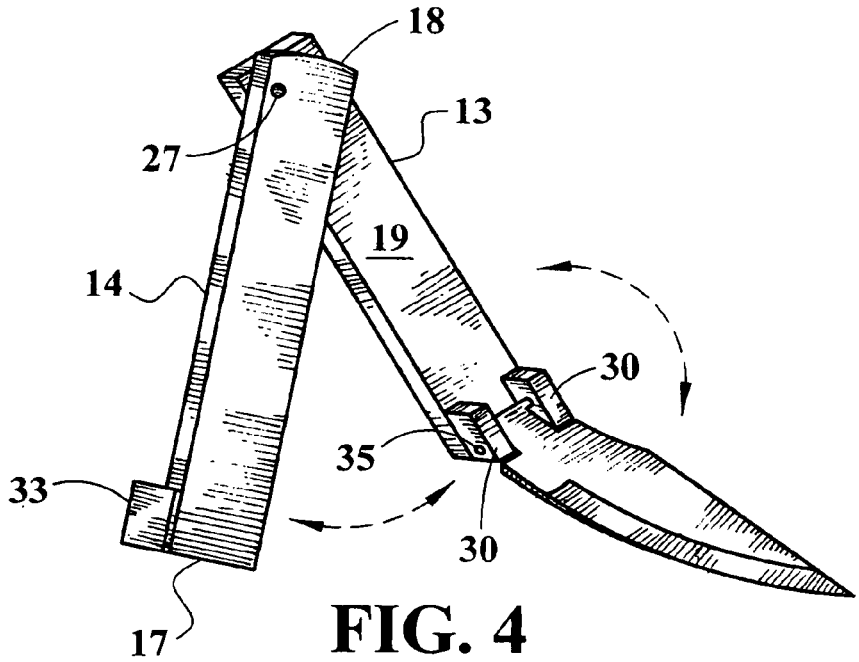
FIG. 4 is a perspective view of the embodiment of FIG. 1 shown in an intermediate position of adjustment between said service and storage states.
Figure 5:
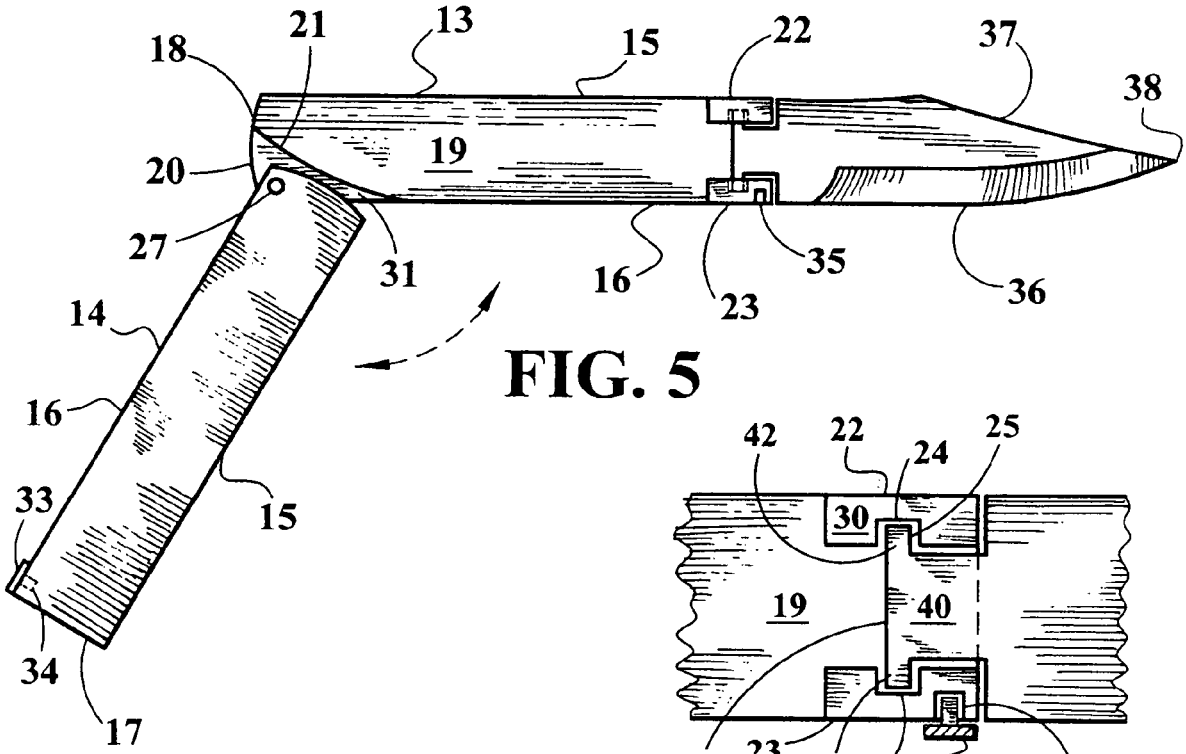
FIG. 5 is a side view showing an intermediate position of adjustment between said service and storage states.
Figure 6:
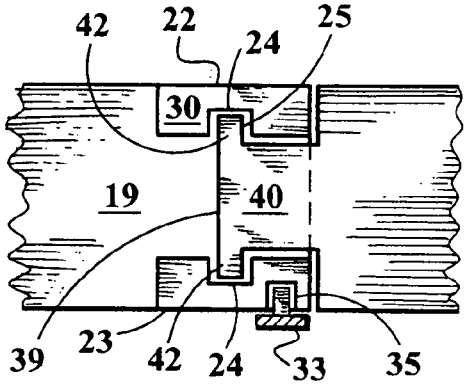
FIG. 6 is an enlarged fragmentary sectional view taken in the direction of the arrows upon line 6—6 of FIG. 3.

Second handle member 14 is attached by first pivot means in the form of pivot pin 27 to spacing shoulder 20. This permits swinging movement of member 14 between a rearward position as shown in FIG. 5, and a forward position, as shown in FIGS. 1–3. Said forward position disposes said interior surfaces 19 in facing relationship, defining a compartment 28 whose width is determined by the thickness of shoulder 20. In achieving said forward or closed position, the interior surface 19 of said second handle member passes in sliding abutment across side surface 31 of said spacing shoulder and distal surfaces 30 of said bearing blocks. Motion limiting means in the form of extension tab 33 protrudes inwardly from lower edge 16 of second handle member 14 adjacent front extremity 17. Said extension tab is intended to abut against lower bearing block 23 in the closed position of the second handle member. In a preferred embodiment, a locking pin 34 is upraised from tab 33 and, in said closed position of the handle member, engages receiving recess 35 in lower bearing block 23. Such feature prevents inadvertent movement of said second handle member away from the closed position.

Blade member 12 is comprised of cutting edge 36, oppositely located non-cutting back edge 37, distal pointed tip 38 and proximal extremity 39 having tang portion 40. The thickness of said tang portion equals the width of compartment 28. The length of blade member 12, measured between said tip and proximal extremity 39, is such as to fit within compartment 28. Second pivot means in the form of stubs 42 of cylindrical contour are oppositely emergent from tang portion 40. Said stubs are configured and positioned so as to be received by recesses 24 in said bearing blocks. Such manner of construction enables the blade member to pivot upon an axis orthogonal to said upper and lower edges and centered between said interior surfaces 19.

Said blade member resides within said compartment in the storage state of the knife. It can be deployed to a service state, as shown in FIGS. 1 and 3, by swinging second handle member rearwardly in a plane parallel to said first handle member, swinging said blade member laterally and forwardly in a path orthogonal to said first handle member, and returning said second handle member forwardly until stopped by said motion limiting means, thereby re-establishing the closed condition of said compartment. In said closed condition of the compartment, tang portion 40 is securely embraced by abutment with the opposed interior surfaces 19 of said handle members.

The aforesaid construction enables the folding knife of this invention to be of rugged, simple design while providing improved safety features in the course of both the storage and service states of the knife.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A folding knife comprising:

a) a handle comprised of first and second elongated members having substantially identical perimeter configurations defined by substantially parallel upper and lower edges, and front and rear extremities, each member having a flat interior surface, said first member having emergent from its interior surface a spacing shoulder adjacent said rear extremity, and pivot holding means adjacent its front extremity, said second handle member being pivotably joined to said spacing shoulder in a manner permitting swinging movement between a rearward open position and forward closed position wherein said interior surfaces are in facing relationship defining a compartment whose width is determined by said spacing shoulder, and motion limiting means associated with the lower edge of said second handle member adjacent its forward extremity, and b) a blade member having a cutting edge and oppositely located non-cutting back edge, a distal pointed tip, a proximal extremity having a tang portion whose thickness equals the width of said compartment, and pivot means associated with said tang portion in a manner to interact with said pivot holding means on an axis orthogonal to said upper and lower edges and parallel to said interior surfaces, the length of said blade, measured between said tip and proximal extremity being such as to fit within said compartment, whereby c) said blade member resides within said compartment in the storage state of said knife, and can be deployed to a service state by swinging said second handle member rearwardly in a plane parallel to said first handle member, swinging said blade member laterally and forwardly in a path orthogonal to said first handle member, and returning said second handle member forwardly until stopped by said motion limiting means, at which point said tang is securely embraced by abutment with the opposed interior surfaces of said handle members.

2. The knife of claim 1 wherein said spacing shoulder has an upwardly concave upper contour and a flat side surface, and extends between said rear extremity and said lower edge.

3. The knife of claim 2 wherein said pivot holding means is comprised of upper and lower bearing blocks emergent from the interior surface of said first handle member and contiguous with said upper and lower edges, respectively.

4. The knife of claim 3 wherein the pivot means associated with said tang portion are stubs of cylindrical contour oppositely emergent from said tang portion in the plane of said blade member.

5. The knife of claim 4 wherein said bearing blocks contain aligned recesses for receiving said stubs.

6. The knife of claim 3 wherein said bearing blocks are bounded in part by flat distal surfaces which are substantially coplanar with the flat side surface of said spacing shoulder.

* * * * *